US009247811B2

(12) United States Patent
Spencer

(10) Patent No.: US 9,247,811 B2
(45) Date of Patent: Feb. 2, 2016

(54) FIREARM SAFE

(71) Applicant: Jeffery Alan Spencer, Morristown, TN (US)

(72) Inventor: Jeffery Alan Spencer, Morristown, TN (US)

(73) Assignee: Jeffery Alan Spencer, Morristown, TN (US)

( * ) Notice: Subject to any disclaimer, the term of this patent is extended or adjusted under 35 U.S.C. 154(b) by 0 days.

(21) Appl. No.: 14/309,575

(22) Filed: Jun. 19, 2014

(65) Prior Publication Data

US 2015/0366343 A1 Dec. 24, 2015

(51) Int. Cl.

| | |
|---|---|
| ***A47B 81/00*** | (2006.01) |
| ***A47B 96/02*** | (2006.01) |
| ***A47B 96/16*** | (2006.01) |
| ***A47B 49/00*** | (2006.01) |
| ***F41C 33/06*** | (2006.01) |
| ***E05G 1/02*** | (2006.01) |
| ***E05G 1/026*** | (2006.01) |

(52) U.S. Cl.

CPC ..... *A47B 81/005* (2013.01); *A47B 49/004* (2013.01); *A47B 96/025* (2013.01); *A47B 96/16* (2013.01); *E05G 1/026* (2013.01); *F41C 33/06* (2013.01)

(58) Field of Classification Search

CPC ..... A47B 46/00; A47B 49/00; A47B 49/004; A47B 53/00; A47B 96/16; A47B 2063/005; A47B 63/06; A47B 63/062; A47B 81/00; A47B 81/005; A47B 61/00; A47B 61/003; A47B 57/40; A47B 57/48; A47B 57/485

USPC ..... 49/388, 394, 395, 316–321; 109/59 R, 109/59 T, 45, 47–49, 53, 56, 57, 64

See application file for complete search history.

(56) References Cited

U.S. PATENT DOCUMENTS

| | | | | | |
|---|---|---|---|---|---|
| 554,252 | A | * | 2/1896 | Falk | 211/64 |
| 712,428 | A | * | 10/1902 | Whitcomb | 211/64 |
| 1,583,180 | A | * | 5/1926 | Mariojas | 312/281 |
| 1,603,127 | A | * | 10/1926 | Lombardo | 312/305 |
| 2,414,752 | A | * | 1/1947 | Mabie | 108/102 |
| 2,457,248 | A | * | 12/1948 | Lemke | 312/329 |
| 2,575,530 | A | * | 11/1951 | Reid | 312/225 |
| 3,101,227 | A | * | 8/1963 | Pugh | 312/300 |
| 3,188,159 | A | * | 6/1965 | Wenger et al. | 312/305 |
| 3,848,940 | A | * | 11/1974 | Berens | 312/135 |
| 5,068,991 | A | | 12/1991 | Reed | |
| 5,087,105 | A | * | 2/1992 | White | 312/245 |
| 5,111,755 | A | | 5/1992 | Rouse | |
| 5,137,239 | A | * | 8/1992 | Horton | 248/220.43 |
| 5,676,257 | A | | 10/1997 | Adkins | |
| 5,701,770 | A | | 12/1997 | Cook et al. | |
| 5,758,933 | A | | 6/1998 | Clendening | |
| 5,901,589 | A | | 5/1999 | Cordero | |

(Continued)

FOREIGN PATENT DOCUMENTS

| | | | | | |
|---|---|---|---|---|---|
| DE | 19700330 | A1 | * | 7/1997 | A47B 57/40 |
| FR | 2940755 | A1 | * | 7/2010 | A47K 1/00 |
| WO | WO 2011113434 | A1 | * | 9/2011 | A47B 47/04 |

*Primary Examiner* — Andrew Roersma

(74) *Attorney, Agent, or Firm* — Pitts & Lake, P.C.

(57) ABSTRACT

A firearm safe with a series of nested, collapsible storage racks and compartments for storing firearms and other valuables attached to a rotatable door, thereby allowing for easy access to all stored items without requiring removal of other items in the safe while safeguarding items against theft or other exposure.

13 Claims, 8 Drawing Sheets

(56) References Cited

U.S. PATENT DOCUMENTS

| | | | | |
|---|---|---|---|---|
| 5,957,308 | A | 9/1999 | Zierenberg | |
| 6,540,092 | B2 | 4/2003 | Sirois | |
| D487,835 | S | 3/2004 | Lynch et al. | |
| D488,300 | S | 4/2004 | Lopez | |
| D493,270 | S | 7/2004 | Lynch et al. | |
| D499,282 | S | 12/2004 | Lynch et al. | |
| D501,620 | S | 2/2005 | Lynch et al. | |
| 6,868,975 | B2 * | 3/2005 | Sells et al. | 211/4 |
| 7,516,709 | B2 | 4/2009 | Bartel et al. | |
| 7,524,002 | B2 | 4/2009 | Punzel et al. | |
| 7,559,428 | B2 * | 7/2009 | Matzick | 211/64 |
| D617,525 | S | 6/2010 | Taylor et al. | |
| 7,857,149 | B2 | 12/2010 | Cummins | |
| 7,963,406 | B2 | 6/2011 | Kinsella | |
| 7,963,621 | B1 * | 6/2011 | Ellis | 312/242 |
| 8,276,527 | B2 * | 10/2012 | Stepp | 109/64 |
| 8,292,094 | B2 | 10/2012 | Morton | |
| 2003/0041787 | A1 * | 3/2003 | Gerstenkorn | 109/73 |
| 2004/0130250 | A1 * | 7/2004 | Cleveland et al. | 312/409 |
| 2004/0140235 | A1 | 7/2004 | Cleveland et al. | |
| 2004/0140280 | A1 * | 7/2004 | Cleveland et al. | 211/64 |
| 2005/0133473 | A1 * | 6/2005 | Lesperance | 211/64 |
| 2005/0264141 | A1 * | 12/2005 | Whitall | 312/204 |
| 2006/0283820 | A1 | 12/2006 | Peters et al. | |
| 2007/0024165 | A1 | 2/2007 | Moulton | |
| 2011/0168649 | A1 | 7/2011 | Stolz | |
| 2013/0002116 | A1 * | 1/2013 | Lodge et al. | 312/351.1 |
| 2013/0133558 | A1 | 5/2013 | Andrews | |
| 2013/0192499 | A1 | 8/2013 | Bartel | |
| 2013/0263763 | A1 | 10/2013 | Pendleton | |
| 2014/0027394 | A1 | 1/2014 | Stepp et al. | |
| 2014/0069880 | A1 | 3/2014 | Spilotro | |

* cited by examiner

FIREARM SAFE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to storage and protection devices, and more particularly, to a safe for firearms, ammunition, documents, and other shooting sport paraphernalia with easy user-access.

2. Description of the Related Art

Today, many Americans own firearms or other types of weapons for recreational use. Many firearm owners own multiple firearms and have a need for safely storing the firearms when they are not in use.

Current gun safes are typically in the form of a metal, upright, rectangular box that includes a rectangular door at the front of the box. These conventional firearm safes typically provide non-movable firearm racks attached to the interior walls of the rectangular box. In such safes, guns stored near the door may be easy to access. However, guns stored deeply inside of the safe, towards the rear wall of the box, are often difficult to retrieve. Often, retrieval of such firearms may require a user to reach deeply within the safe and/or to remove other items from the safe before he or she is able to reach deeply into the safe. This type of operation is cumbersome, and in some circumstances, may result in damage to the guns and possibly personal injury to the user. Difficulty in accessing and retrieving stored firearms may result in damage to guns from nicking or striking against each other and the interior of the safe. Thus, the structure and orientation of conventional gun safes often creates situations in which guns are poorly secured within the safe, storage potential is underutilized, and it is difficult and time consuming to store and retrieve guns or other related items.

Conventional gun safes utilize either "internal" or "external" hinges and latches located along one or more sides of the safe door. The primary disadvantage of external hinges and latches is that they are exposed, mounted on the safe exterior, which makes them vulnerable to tampering, and thus, potential targets of would-be thieves. While destruction of hinges or latches on a gun safe may or may not compromise the security of a safe, such damage is expensive to repair. However, one disadvantage of traditional internal hinges and latches is that they occupy valuable storage space, both in their static position and in the arc through which they must travel when the door is operated. Internal hinges also restrict the degree to which the safe door may be opened.

In light of the above, there is a need for a firearm storage device that allows for unimpeded access to all, or most, stored items therein without requiring removal of any items, and while also providing convenient user access and security.

BRIEF SUMMARY OF THE INVENTION

Described herein is a firearm safe with a storage system for firearms and other valuables attached to the door, thereby allowing for easy access to all stored items without requiring removal of any items in the safe while safeguarding items against theft or other exposure.

In some of its many embodiments, the present general inventive concept provides a rectangular (or other suitably shaped) enclosure of protective material and a door for access to the rectangular (or other suitably shaped) enclosure that is hinged along a central vertical axis. Attached to the door is a series of nested, collapsible storage racks and compartments for storing firearms, ammunition, various other shooting sport paraphernalia, documents, and other items of value. A user may rotate the door about the central vertical axis such that the nested, collapsible storage compartments become easily accessible outside the confines of the original enclosure. Once rotated to the outside, the interior storage compartments may be expanded to expose stored items for use. The interior storage assembly may be made up of various storing compartments and devices such as shelves, racks, dividers, box, etc. The firearm safe may also be used to store firearms or valuables for commercial or personal purposes.

BRIEF DESCRIPTION OF THE DRAWINGS

The above-mentioned and additional features of the invention will become more clearly understood from the following detailed description of the invention read together with the drawings in which.

DETAILED DESCRIPTION OF THE INVENTION

In accordance with several features of the present general inventive concept, various exemplary embodiments of a firearm safe are disclosed herein and in the accompanying figures. In several embodiments, the firearm safe, or "safe," provides a substantially enclosed outer housing having a door along a front wall thereof which is rotatable in relation to the remaining walls of the housing about a central vertical axis of the door. A series of nested, collapsible storage racks and compartments (hereinafter "racks") are secured along a surface of the door, the racks being useful, for example, for storing firearms, ammunition, other shooting or sports paraphernalia, documents, or other items of value. The door is rotatable between an "opened" position, in which the surface of the door along which the racks are mounted faces an exterior of the housing, and a "closed" position, in which the surface of the door along which the racks are mounted faces an interior of the housing. Thus, when the door is moved to the opened position, the racks are carried to the exterior of the housing, thereby allowing easy access to the racks, and when the door is moved to the closed position, the racks are carried to the interior of the housing and enclosed by the housing and door. Thus, in the closed position, items stored in the racks may be protected against theft or exposure.

One embodiment of a safe constructed in accordance with several features of the present general inventive concept is illustrated in FIGS. 1-5. With initial reference to FIGS. 1 and 2, the safe 10 includes a substantially rectangular outer housing 12 having a plurality of walls 14, 16, 18, 20, 22, joined along adjacent edges thereof to define a substantially enclosed interior 24. The housing 12 is fabricated from a generally rigid and strong material, such as for example metal, fiberglass, polymer, wood, or the like, such that the various walls 14, 16, 18, 20, 22 of the housing 12 provide a protective enclosure of the interior 24. In several embodiments, the various walls 14, 16, 18, 20, 22 of the housing 12 may include multiple layers of material, and in certain embodiments, may include one or more layers of insulating and/or fireproof material such that the interior 24 is substantially protected against heat exposure from external of the housing 12. In the embodiment of FIGS. 1-5, the housing 12 defines a rectangular shape. However, it will be recognized that other shapes, such as for example cylindrical or semi-cylindrical, spherical, triangular prismatic, and the like, may be used without departing from the spirit and scope of the present general inventive concept.

Figure 2:
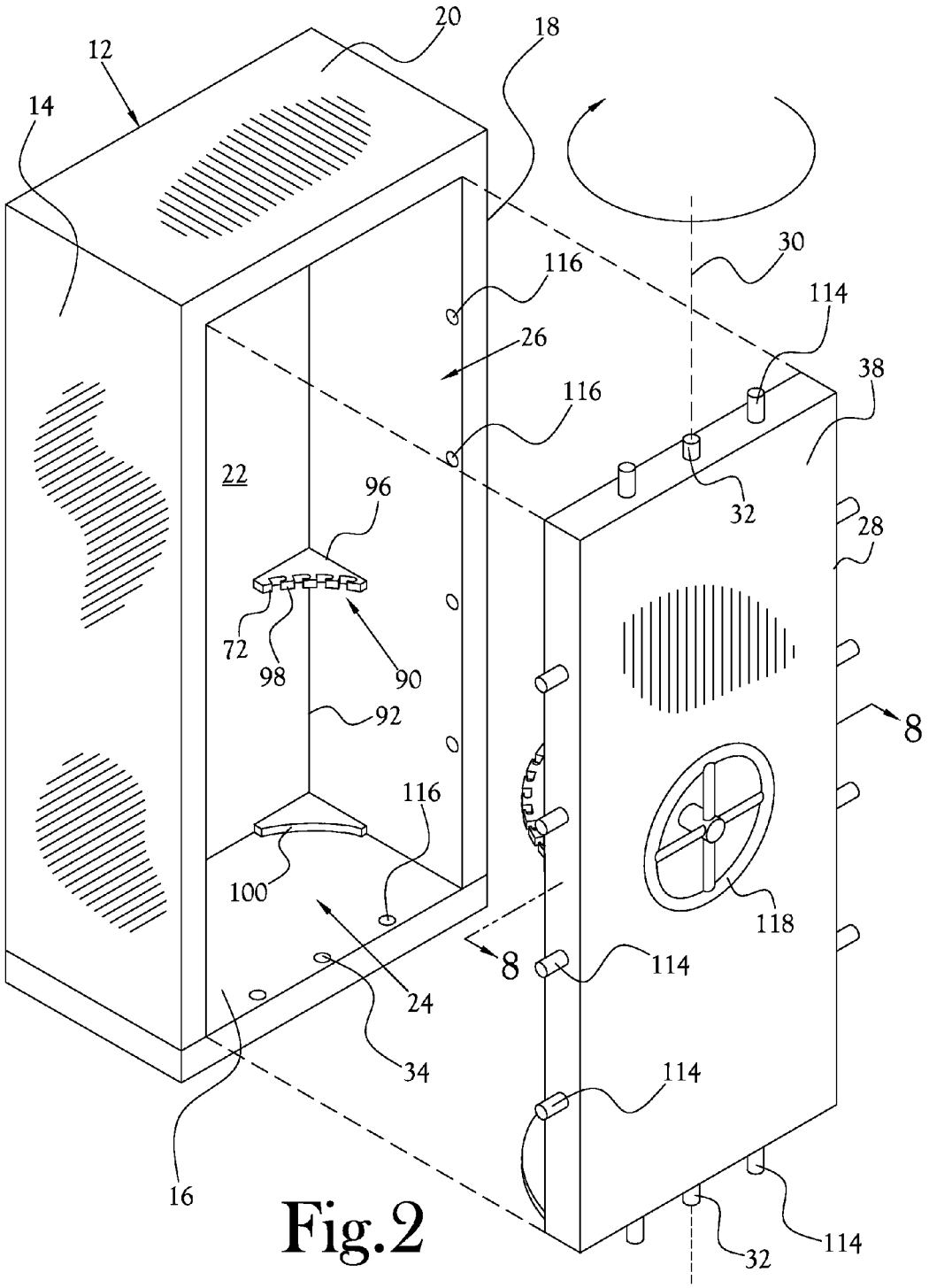
FIG. 2 is an exploded view of the firearm safe of FIG. 1.

At least one surface of the housing 12 defines an opening 26 for allowing access to the interior 24 of the housing 12. For example, in the illustrated embodiment, front edges of the top wall 20, the first and second side walls 14, 18, and the bottom wall 24 cooperate to define an opening 26 which is of the same approximate size and shape as an interior surface of the rear wall 22. A door 28 is received within the opening 26 and is sized to fit in close conformity to the opening 26. In the embodiment of FIG. 2, the door 28 is rotatably mounted within the opening 26 about a central vertical axis 30 of the door 28. More specifically, in the illustrated embodiment, a pair of cylindrical pins 32 are provided, with each pin 32 protruding from one of opposite top and bottom ends of the door 28 coaxial with the central vertical axis 30. Each pin 32 is received within a corresponding mating recess 34 defined along interior surfaces of the top and bottom walls 20, 16 of the housing, proximate the opening 26, such that each pin 32 may rotate within its corresponding recess 34.

It will be recognized that the above-discussed arrangement of the pins 32 and corresponding recesses 34 allows for rotatable mounting of the door 28 within the opening 26 and along the central vertical axis 30 such that the rotatable mounting hardware of the door 28 along the central vertical axis 30 is completely contained within the geometry of the door 28 and housing 12. Thus, such hardware is not exposed to the safe exterior, and therefore is less vulnerable to attack from the exterior of the safe 10. Furthermore, it will be recognized that the above-discussed arrangement of the pins 32 and corresponding recesses 34 allows for mounting hardware for the door 28 which does not occupy additional space within the storage area. However, those of skill in the art will recognize that other suitable devices and configurations exist for establishing rotatable connection of the door 28 to the housing 12 within the opening 26, such that the door 28 is rotatable about the central vertical axis 30, and such other devices and configurations may be used without departing from the spirit and scope of the present general inventive concept. Furthermore, it will be recognized that, in other embodiments, the door 28 and corresponding opening 26 may be sized to occupy only a portion of a surface of the housing 12 without departing from the spirit and scope of the present general inventive concept.

Figure 1:
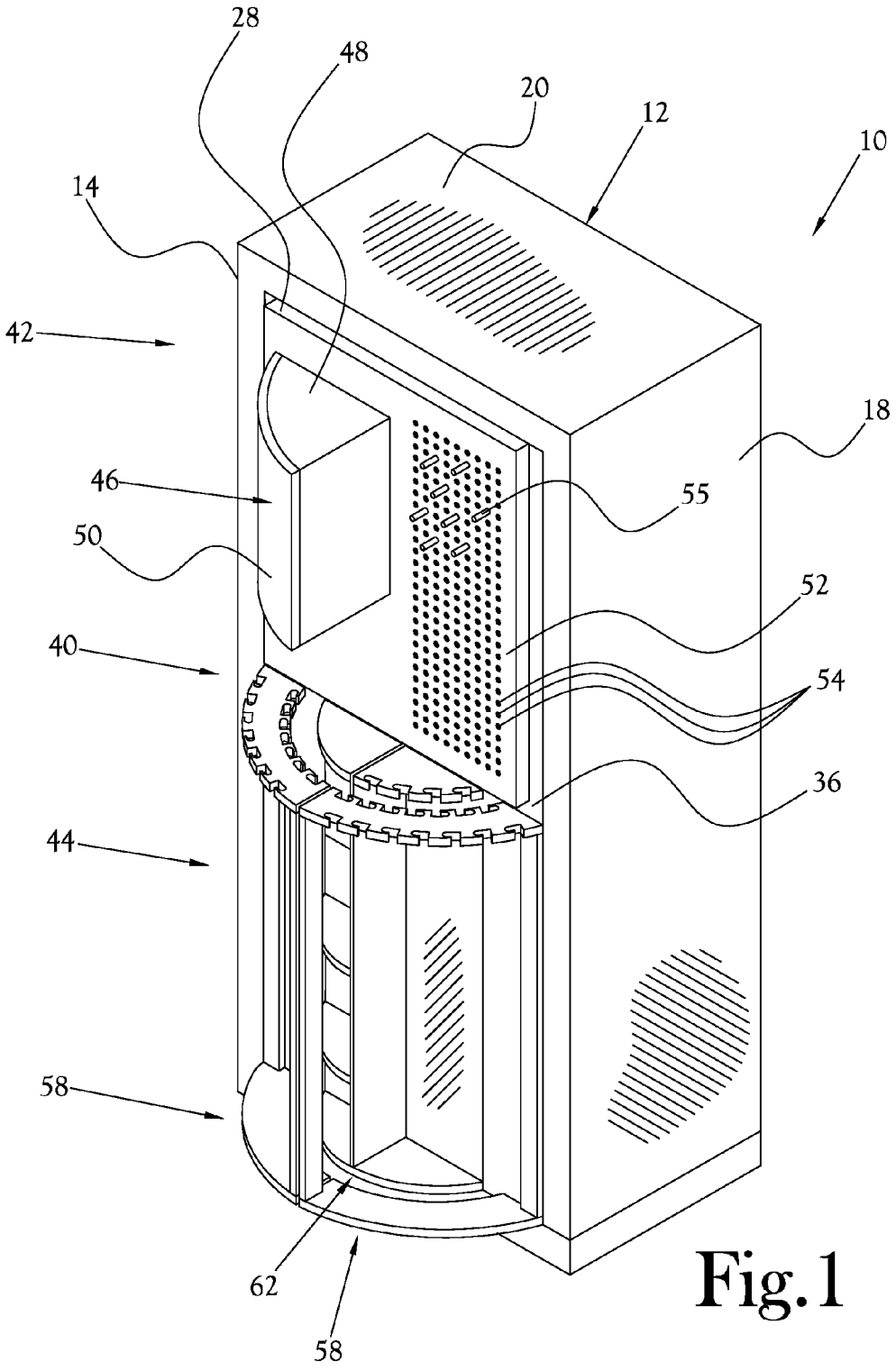
FIG. 1 is a perspective view of one example embodiment of firearm safe constructed in accordance with several features of the present general inventive concept.
Figure 3:
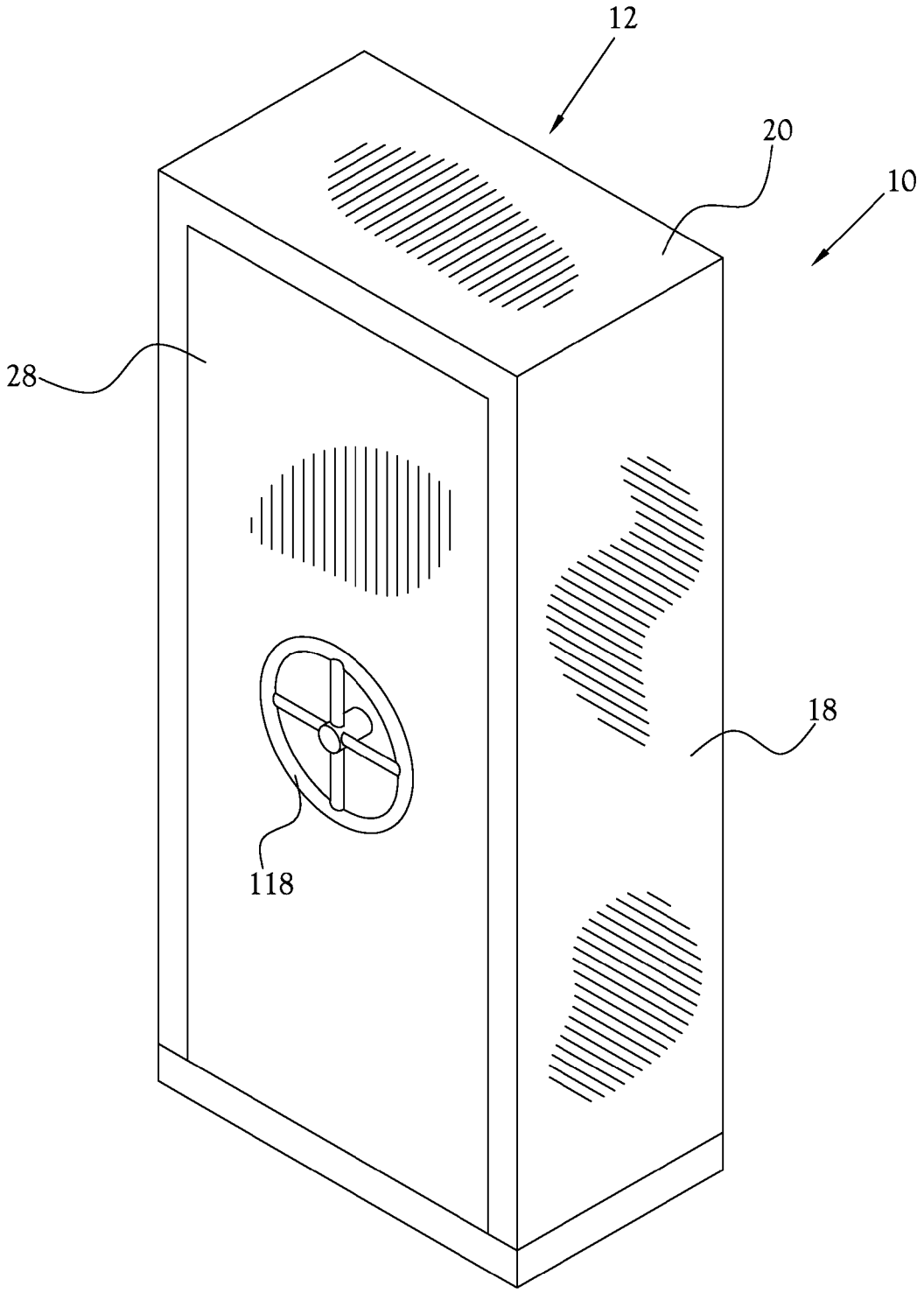
FIG. 3 is a perspective view of the firearm safe of FIG. 1, showing the door of the safe in a closed position.

Referring to FIGS. 1 and 3, the door 28 defines a first major surface 36 which is configured to face the interior 24 of the housing 12 in the closed position of the door 28 (see FIG. 3) and an exterior of the housing 12 in the open position of the door 28 (see FIG. 1). Conversely, the door 28 defines an opposite second major surface 38 which is configured to face outwardly from the housing 12 in the closed position of the door 28 (see FIG. 3) and an interior of the housing 12 in the open position of the door 28 (see FIG. 1). In several embodiments, a storage assembly 40 is provided along the first major surface 36. As will be discussed in further detail below, the storage assembly 40 comprises at least one, and preferably a plurality of storage racks, shelves, cabinets, or the like, which are configured to hold one or more firearms and/or firearm accessories. In several embodiments, various components forming the storage assembly 40 define outer perimeter limits conforming generally to a half-cylinder shape having a radius slightly smaller than a radius of rotation of the door 28, such that the overall size of the storage assembly 40 is generally maximized while still allowing for rotation of the door 28 and associated storage assembly 40 between the open position and the closed position With reference to FIGS. 1, 4, and 5, in the illustrated embodiment, the storage assembly 40 includes generally an upper storage unit 42 and a lower storage unit 44. The upper storage unit 42 includes a storage locker 46 which is mounted along an upper quadrant of the first major surface 36 of the door 28. In the illustrated embodiment, the storage locker 46 defines generally a quarter-cylinder shaped box 48 having an arcuate outer door 50. The box 48 is generally sized to hold one or more pistols and/or firearm accessories, such as for example ammunition and magazines, holsters and firearm cases, tools, flashlights, safety glasses and auditory protective devices, instruction manuals and other paperwork, etc. In some embodiments, the box 48 may include one or more shelves or additional storage racks defined along an interior thereof, however, such additional shelves and racks are not essential to the present general inventive concept.

Figure 6:
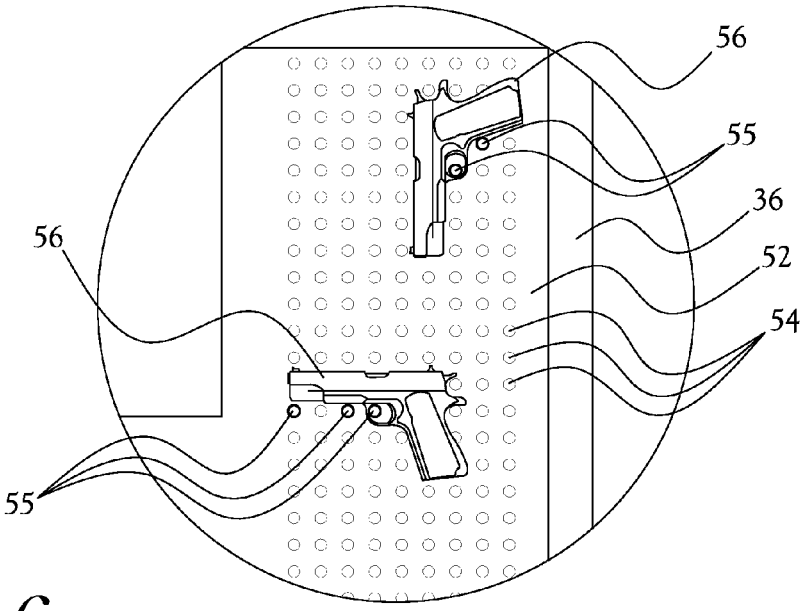
FIG. 6 is a partial side view showing certain applications of the perforated hardboard of the firearm safe of FIG. 1 in accordance with several features of the present general inventive concept.

In the illustrated embodiment, the upper storage unit 42 further includes a perforated hardboard 52 which extends along a remainder of the upper portion of the first major surface 36 of the door 28. The perforated hardboard 52 defines a plurality of through bores 54 configured to receive therein one or more pins, pegs, rods, or the like for hanging one or more peggable items along the hardboard 52. For example, as shown in greater detail in FIG. 6, in certain applications, one or more pegs 55 may be secured within corresponding through bores 54 in the hardboard 52, and one or more pistols 56 or other items may be hung from the various pegs 55. In certain applications, a peg 55 may be received within a trigger guard of a pistol 56 to allow the pistol 56 to be hung along the hardboard 52. In other applications, one or more pegs 55 may be positioned at peripheral locations about a pistol 56 to allow the pistol 56 to be mounted along the hardboard 52. Those of skill in the art will recognize other applications of the present general inventive concept in which peggable items may be secured along the hardboard 52.

Figure 4:
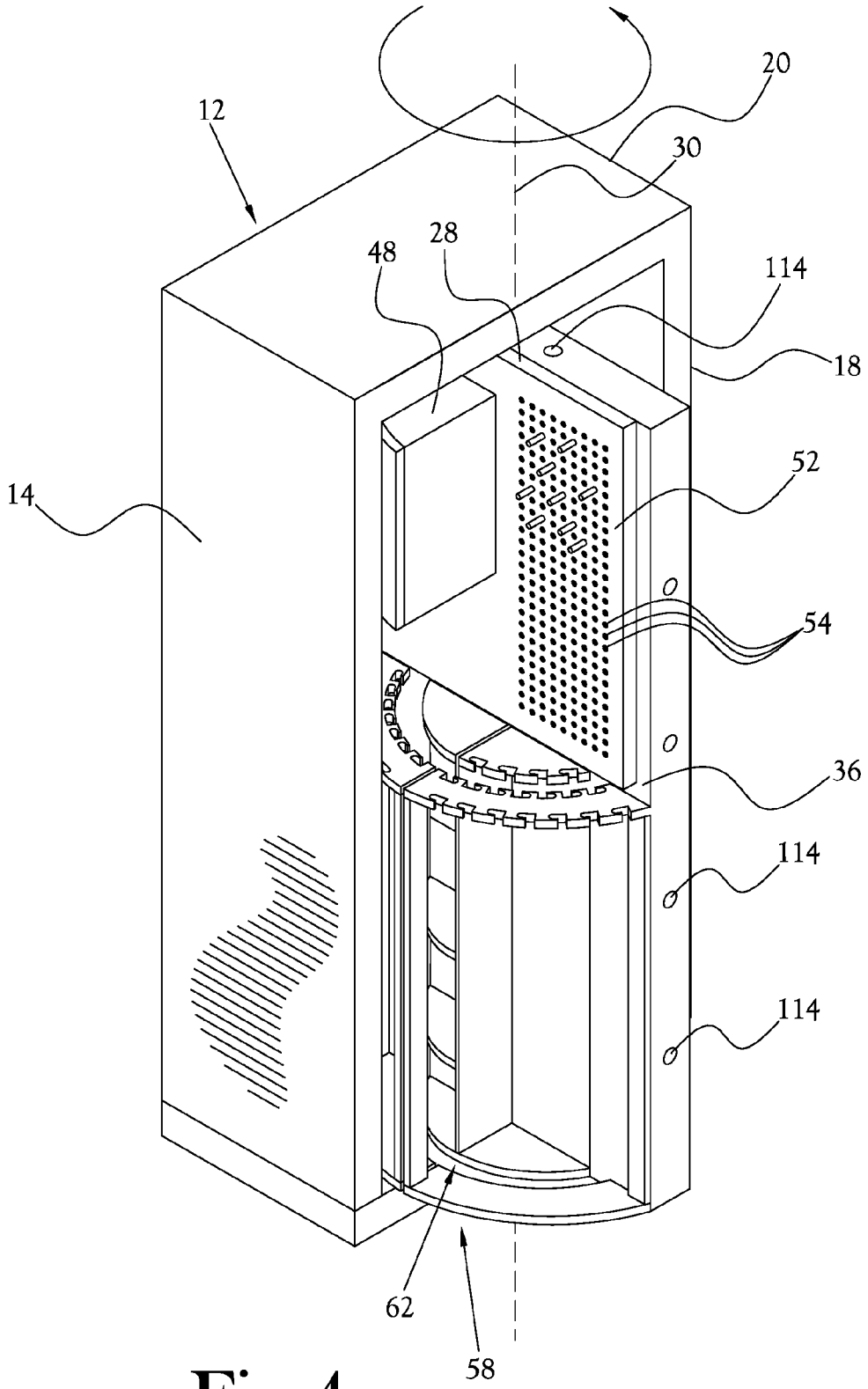
FIG. 4 is a perspective view of the firearm safe of FIG. 1, showing the door of the safe in a partially-opened position.
Figure 5:
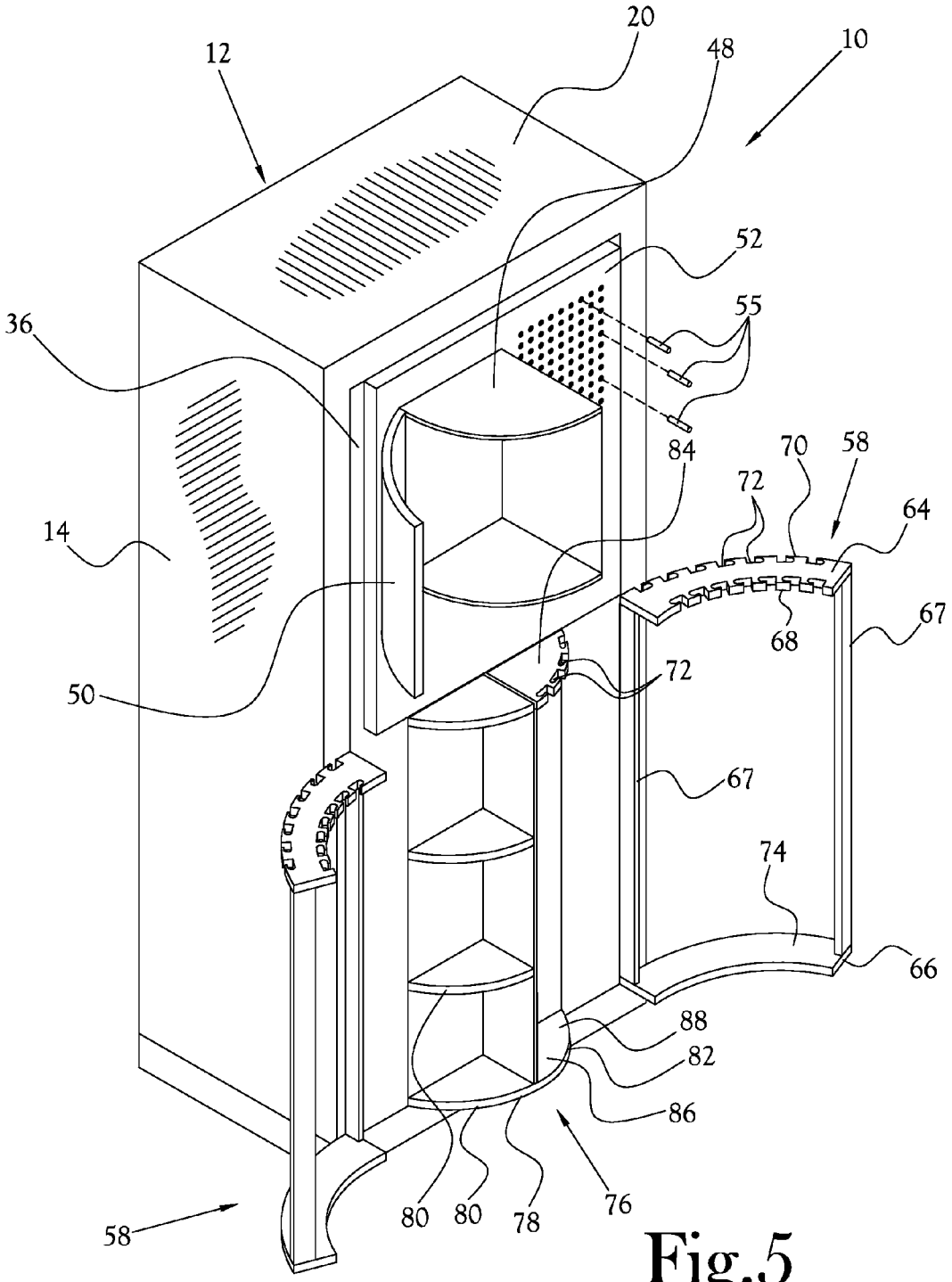
FIG. 5 is a perspective view of the firearm safe of FIG. 1, showing the door of the safe in an opened position and various elements of the storage assembly in expanded positions.
Figure 7:
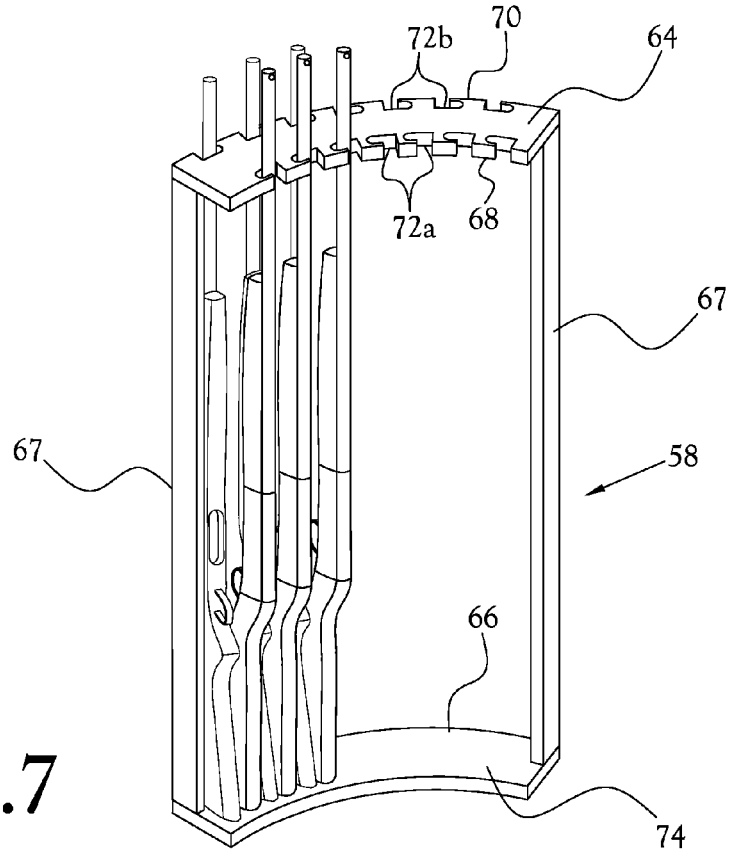
FIG. 7 is a perspective view showing one embodiment of an outer rack portion of a firearm safe constructed in accordance with several features of the present general inventive concept.

In the embodiment of FIGS. 1, 4, and 5, the lower storage unit 44 includes a pair of outer racks 58 and an inner shelf system 76. With reference to FIGS. 5 and 7, in one embodiment, each outer rack 58 defines generally an upper support member 64 and a corresponding lower support member 66 extending along respective horizontal planes and held in overlapping, parallel-planar, spaced apart relationship to one another by a plurality of support members 67. Each upper support member 64 is defined by a generally planar segment extending along a substantially quarter-circle arcuate path, such that each upper support member 64 defines an inner curved edge 68 and opposite outer curved edge 70. Each inner and outer curved edge 68, 70 defines a plurality of notches 72 which are sized and shaped to receive therein the muzzle end of a long gun, such as for example a shotgun, rifle, etc. Each lower support member 66 is defined by a generally planar arcuate segment of similar overall size and shape, and extending beneath, the upper support member 64. Each lower support member 66 defines an upper surface 74 which is configured to engage and carry thereon a butt end of a long gun whose muzzle end is received by one of the notches 72 of the upper support member 64. Thus, upon placing a muzzle end of a long gun within one of the notches 72 of the upper support member 64 and placing the butt end of the long gun onto the upper surface 74 of the lower support member 66, the upper and lower support members 64, 66 cooperate to support and maintain the long gun in an upward-pointed orientation within the outer rack 58.

As shown in FIG. 7, in one embodiment, each of the notches 72*a* of the inner curved edge 68 is offset along the arc of the upper support member 64 between two notches 72*b* of the outer curved edge 70. Thus, when the outer rack 58 is filled with long guns, each long gun received by a notch 72*a* of the inner curved edge 68 is positioned between two long guns received by adjacent notches 72*b* in the outer curved edge 70. Likewise, with the exception of the arcuately outermost long guns, each long gun received by a notch 72*b* of the outer curved edge 70 is positioned between two long guns received by adjacent notches 72*a* in the inner curved edge 68.

As shown in FIG. 5, in several embodiments, each of the outer racks 58 is hinged to the first major surface 36 of the door 28 along outer vertical edges thereof, such that the outer racks 58 may be rotated outwardly from one another along outer vertical edges in relation to the first major surface 36 of the door 28, thereby making the notches 72*a* along the inner curved edge 68 more accessible for insertion or removal of a long gun. In several embodiments, a semi-cylindrical inner shelf system 76 is secured to the lower portion of the first major surface 36 between the hinged vertical edges of the outer racks 58, such that the outer racks 58 may be rotated outwardly from the first major surface 36 to expose the inner shelf system 76, thereby also making the inner shelf system 76 more accessible to a user.

The inner shelf system 76 may comprise any of a variety of shelves, racks, or other storage devices of the type discussed above. For example, in the illustrated embodiment, the inner shelf system 76 includes a quarter-cylinder shaped first half 78 defining a plurality of shelves 80, and an adjacent quarter-cylinder shaped second half 82 defining an upper support member 84 and a lower support member 86. Similar to the above-discussed outer racks 58, the upper support member 84 of the inner shelf system second half 82 defines a plurality of notches 72 defined along an outer curved surface thereof, each of which is configured to receive a muzzle end of a long gun, and the lower support member 86 defines an upper surface 88 which is configured to receive thereon and carry a butt end of a long gun.

It will be recognized that the type, position, and orientation of the various racks and storage compartments of the storage assembly 40 may vary depending on the specific needs for storage within the safe 10 without departing from the spirit and scope of the present general inventive concept. For example, it will be recognized that numerous other types, combinations, and orientations of shelves, cabinets, racks, etc., may be used to form the inner shelf system 76, or the upper or lower storage units 42, 44 without departing from the spirit and scope of the present general inventive concept. To this end, in some embodiments, the configurations for the upper and lower storage compartments 42, 44 may be reversed from that described above. In other embodiments, the upper and lower storage units 42, 44 may each comprise configurations of storage compartments and racks which are similar, or even identical, to one another.

As noted above, in several embodiments, the various components of the storage assembly 40 are shaped such that the storage assembly itself is confined within an overall semi-cylindrical shape protruding from the first major surface 36 of the door 28. Thus, as the door 28 is rotated about its central axis 30 between the opened and closed positions, the storage assembly 40 is able to clear the limits of the opening 26 in the housing 12. Referring now to FIG. 2, in several embodiments, additional storage racks 90 are provided along rear interior corners 92 of the housing 12, and are shaped so as not to impede rotation of the door 28 and storage assembly 40 between the opened and closed position. In the illustrated embodiment, each additional storage rack 90 includes an upper support member 96 defining a concave outer edge 98, along which are defined additional notches 72, of the type described above. A lower support member 100 is provided below the upper support member 96 which has a similar shape as the upper support member 96. Thus, in the illustrated embodiment, additional long guns may be stored in the additional storage racks 90 and accessed by a user when the door 28 is rotated to a partially opened position (see FIG. 4).

Figure 8:
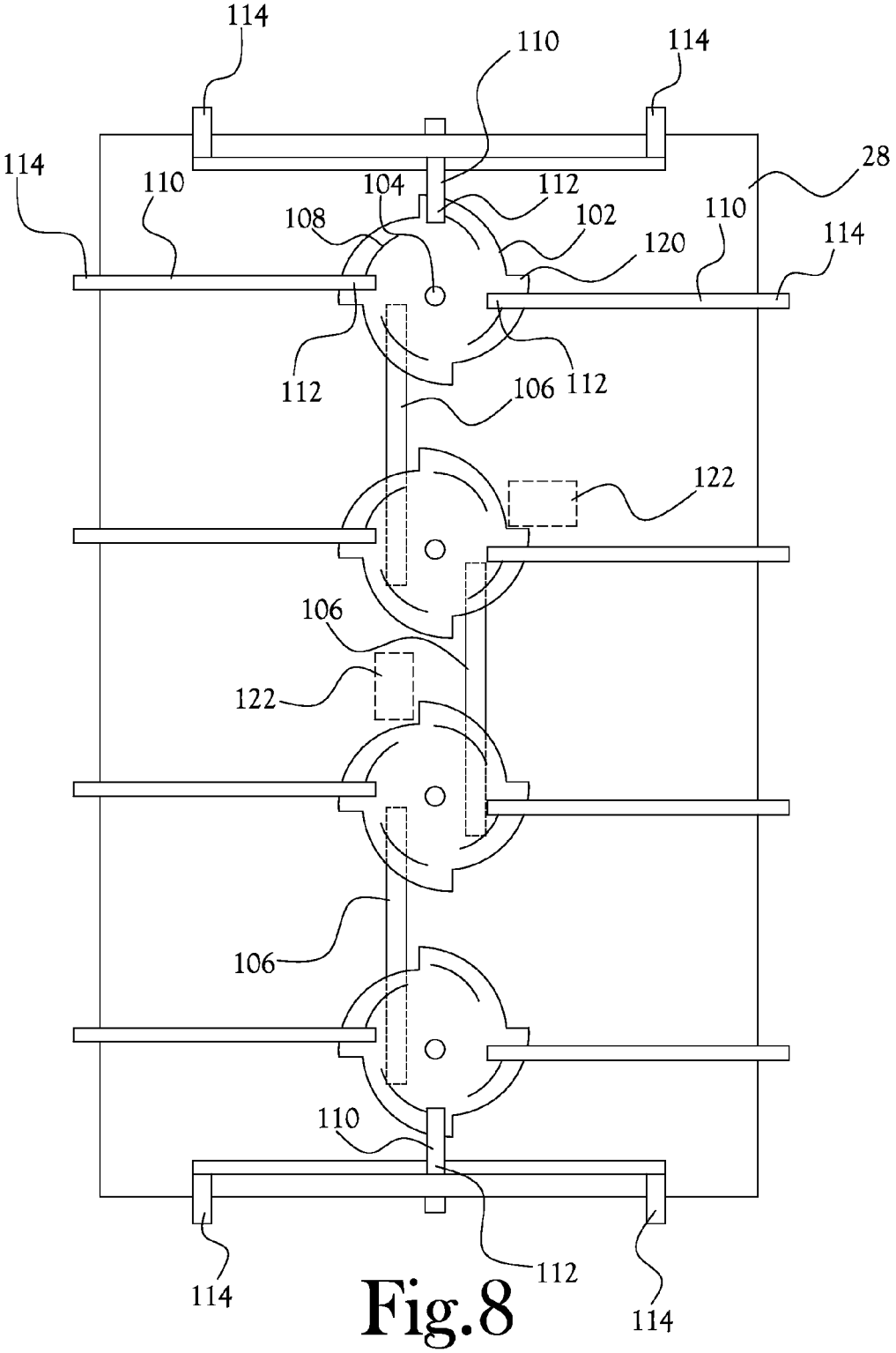
FIG. 8 is a schematic representation of a cross-sectional side view of a door of a firearm safe, showing one embodiment of a locking mechanism constructed in accordance with several features of the present general inventive concept, with the locking mechanism in a locked configuration.
Figure 9:
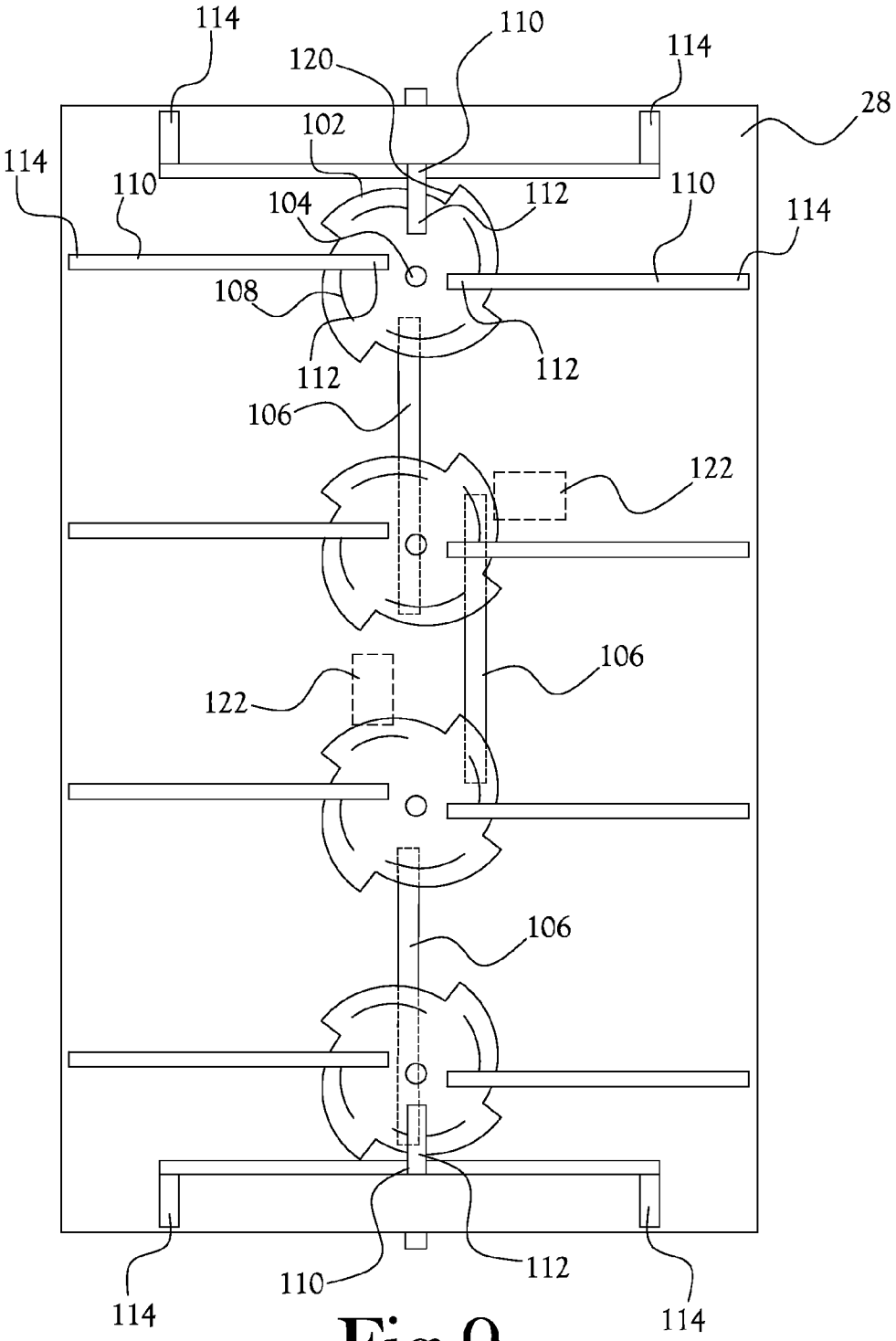
FIG. 9 is a schematic representation of a cross-sectional side view of a door of a firearm safe, showing the embodiment of the locking mechanism of FIG. 8 in an unlocked configuration.

In several embodiments, the door 28 is provided with a locking mechanism which is selectively lockable to maintain the door 28 in the closed position and unlockable to allow rotation of the door 28 between the opened and closed positions. For example, as shown in FIGS. 8 and 9, in one embodiment, a plurality of cam wheels 102 are provided along an interior of the door 28, rotatably mounted within the door 28 about central axes 104 of the cam wheels 102. Each cam wheel 102 defines a plurality of helical-shaped cam grooves 108 extending circumferentially and radially outward along respective portions of the cam wheel 102. A plurality of elongated bolts 110 are provided, with each bolt 110 having a first end 112 slidably engaging an associated cam groove 108 and a second end 114 extending outwardly from the cam wheel 102 and along the door 28 toward an outer edge thereof. Each bolt 110 is further limited to slidable movement along the long dimension of the bolt 110. Thus, each cam wheel 102 may be rotated about its central axis 104 to a locked position (FIG. 8), in which each bolt first end 112 associated with the cam wheel 102 is positioned at a radially outward end of its associated cam groove 108. In this configuration, each bolt 110 extends outwardly along its long dimension and exceeds outer perimetral limits of the door 28. Referring to FIG. 2, a plurality of recesses 116 are provided along the opening 26 in the housing 12, each recess 116 being aligned with a respective bolt 110 and configured to receive and mate with its respective bolt second end 114 in the locked position, thereby securing the door 28 within the opening 26. Each cam wheel 102 may further be rotated about its central axis 104 to an unlocked position (FIG. 9), in which each bolt first end 112 associated with the cam wheel 102 is positioned at a radially inward end of its associated cam groove 108. In this configuration, each bolt 110 is retracted along its long dimension such that the bolt second end 114 no longer exceeds the outer perimetral limits of the door 28. Thus, in this configuration, the door 28 may be free to rotate about its central axis 30.

In the illustrated embodiment, each of the cam wheels 102 is provided in rotational engagement with another cam wheel 102 via suitable mechanical linkages, such that rotation of one cam wheel 102 about its central axis 104 results in rotation of the remaining cam wheels 102 about their respective central axes 104. For example, in the illustrated embodiment, a plurality of elongated linking members 106 are provided extending between and rotatably secured to corresponding points along adjacent cam wheels 102. Thus, when one cam wheel 102 is rotated in a clockwise or counter-clockwise direction, the remaining cam wheels 102 are rotated in the same direction. In another embodiment (not shown), each cam wheel 102 may form a mirror image to an adjacent cam wheel 102, and a gear may be provided in mechanical engagement between adjacent cam wheels 102, such that rotation of one cam wheel 102 in one direction results in rotation of its adjacent cam wheels 102 in the opposite direction. Those of skill in the art will recognize other suitable devices and configurations by which movement of the various cam wheels 102 may be coordinated with one another, such that movement of one cam wheel 102 between locked and unlocked positions results in movement of the remaining cam wheels 102 to the same locked or unlocked position, and such other suitable devices and configurations may be used without departing from the spirit and scope of the present general inventive concept.

Referring to FIGS. 2, 8, and 9, the safe 10 is equipped with a suitable door control 118, such as for example a knob, wheel, lever handle, or the like, disposed along the second major surface 38 of the door 28. The door control 118 is in operative mechanical communication with at least one of the cam wheels 102 to control rotation of the cam wheels 102 between the locked and unlocked positions. In the illustrated embodiment, the door control 118 comprises a wheel which may be rotated to effect rotation of the cam wheels 102 between the locked and unlocked positions. A suitable lock of the type known to one of ordinary skill in the art, such as for example a combination lock, key lock, etc., may be provided in engagement with the door control 118 to limit rotational movement of the door control 118 and associated cam wheels 102. For example, in the illustrated embodiment, each of the cam wheels 102 defines a plurality of dog recesses 120 which may be engaged by one or more bearing blocks 122 to limit rotational movement of the cam wheels 102 from the locked position toward the unlocked position. Actuation of the lock may effect movement of the blocks 122 to positions which do not interfere with rotational movement of the cam wheels 102, thereby permitting movement of the cam wheels 102 to the unlocked position.

From the foregoing description, it will be recognized that a firearm safe is provided which allows for convenient and secure storage and access of firearms and other such items. While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A firearm safe for storing firearms and other valuables, comprising:

a substantially enclosed outer housing defined by a plurality of walls with at least one surface of the housing defining an opening for access to an interior of the housing;

a door rotatably mounted within the opening of the housing about a central vertical axis of the door; and a storage assembly having a plurality of collapsible and expandable storage members secured along a surface of the door, wherein the storage assembly includes a pair of outer racks, wherein each outer rack defines an upper support member and a corresponding lower support member extending along respective horizontal planes and held in overlapping, parallel-planar, spaced apart relationship to one another by a plurality of supports, wherein each upper support member is defined by a planar segment extending along a substantially quarter-circle arcuate path, such that each upper support member defines an inner curved edge and an opposite outer curved edge, and wherein each inner and outer curved edge defines a plurality of notches adapted to receive one end of a long gun, and each of the notches of the inner curved edge is offset along an arc of the upper support member between two notches of the outer curved edge such that a long gun received by a notch of the inner curved edge is positioned between two other long guns received by adjacent notches in the outer curved edge.

2. The firearm safe of claim 1, wherein the storage assembly is confined within a semi-cylindrical shape along the surface of the door.

3. The firearm safe of claim 1, wherein the storage assembly comprises an upper storage unit and a lower storage unit.

4. The firearm safe of claim 1, wherein the storage members of the storage assembly define an outer perimeter limit conforming to a substantially half-cylinder shape having a radius slightly smaller than a radius of rotation of the door.

5. The firearm safe of claim 1, wherein the storage assembly includes a storage locker.

6. The firearm safe of claim 1, wherein the storage assembly includes a perforated hardboard that further defines a plurality of through bores configured to receive therein one or more pins, pegs, or rods for hanging one or more peggable items along the hardboard.

7. The firearm safe of claim 1, wherein the storage assembly comprises a semi-cylindrical inner shelf system secured between the surface of the door and a hinged vertical edge of the outer racks, such that the pair of outer racks is rotated outwardly from the surface of the door to expose the inner shelf system.

8. The firearm safe of claim 1, further comprising a locking mechanism wherein a plurality of cam wheels is rotatably mounted along the interior of the door about a central axis.

9. The firearm safe of claim 8, wherein each of the cam wheels is in rotational engagement with another cam wheel, such that rotation of one cam wheel about its central axis results in rotation of the remaining cam wheels about their respective central axes.

10. The firearm safe of claim 1, wherein the door is rotatably mounted within the opening of the outer housing about the central vertical axis with a rotatable mounting mechanism such that a mounting hardware of the door along the central vertical axis is completely contained within the geometry of the door and the housing.

11. The firearm safe of claim 10, wherein the rotatable mounting mechanism comprises a mechanical arrangement of a plurality of pins and corresponding recesses such that each pin is rotatable within its corresponding recess.

12. The firearm safe of claim 7, wherein the inner shelf system includes a quarter-cylinder shaped first half defining a plurality of shelves and an adjacent quarter-cylinder shaped second half defining an upper support member and a lower support member.

13. The firearm safe of claim 1, further comprised of at least one storage rack along a rear interior corner of the housing which is shaped so as not to impede rotation of the door and the storage assembly between the opened and closed position of the door.

* * * * *